US005984758A

United States Patent [19]

Driska et al.

[11] Patent Number: 5,984,758

[45] Date of Patent: Nov. 16, 1999

[54] SIMULATED COMPUTER

[75] Inventors: John Driska, Princeton Junction, N.J.; Isaac Ashkenazi, Brooklyn, N.Y.

[73] Assignee: Kiddesigns, Inc., Rahway, N.J.

[21] Appl. No.: 09/126,184

[22] Filed: Jul. 30, 1998

[51] Int. Cl.[6] ..... A63H 33/30

[52] U.S. Cl. ..... 446/143; 446/408; 446/485

[58] Field of Search ..... 446/81, 143, 397, 446/404, 408, 484, 485

[56] References Cited

U.S. PATENT DOCUMENTS

| | | | |
|---|---|---|---|
| 4,072,314 | 2/1978 | Rosen et al. | 446/485 X |
| 5,145,447 | 9/1992 | Goldfarb | 446/143 X |
| 5,228,879 | 7/1993 | Fromm | 446/485 X |
| 5,312,284 | 5/1994 | Grober et al. | 446/143 |
| 5,382,188 | 1/1995 | Tomellini | 446/397 |
| 5,433,610 | 7/1995 | Godfrey et al. | 446/397 X |
| 5,551,905 | 9/1996 | Billings et al. | 446/408 X |
| 5,679,049 | 10/1997 | Arad et al. | 446/484 X |

*Primary Examiner*—John A. Ricci
*Attorney, Agent, or Firm*—Amster, Rothstein & Ebenstein

[57] ABSTRACT

A simulated computer includes a plurality of images, including at least one character image and a plurality of activity images, and user-operable keys for selecting one of the images, a selected one of the activity images being illuminated to indicate the selected activity. A sound chip simulates talk by a character represented by the character image, the character image being illuminated during simulated talk by the character. User-operable keys are provided for selecting a simulated computer function. A microprocessor performs a sequence of simulated computer play, including a plurality of sequential events, the sequence of play commencing at an event responsive to the selected computer function.

6 Claims, 3 Drawing Sheets

FIG. 1
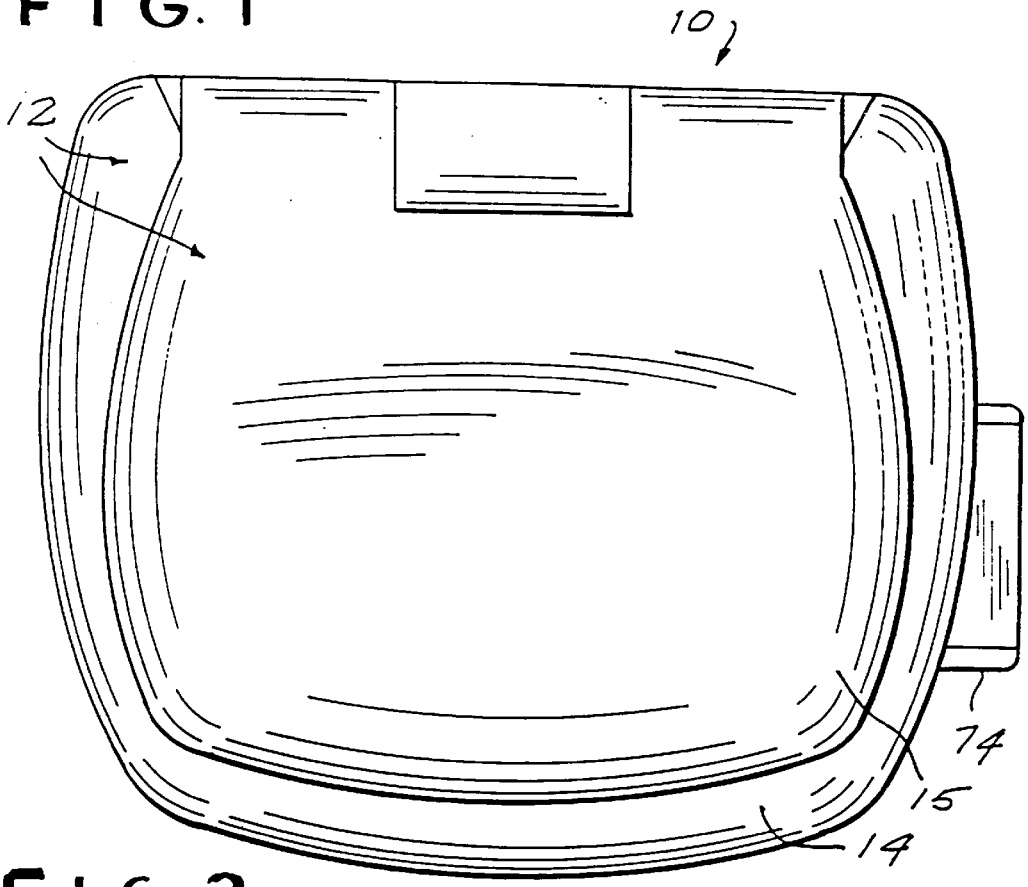
FIG. 2
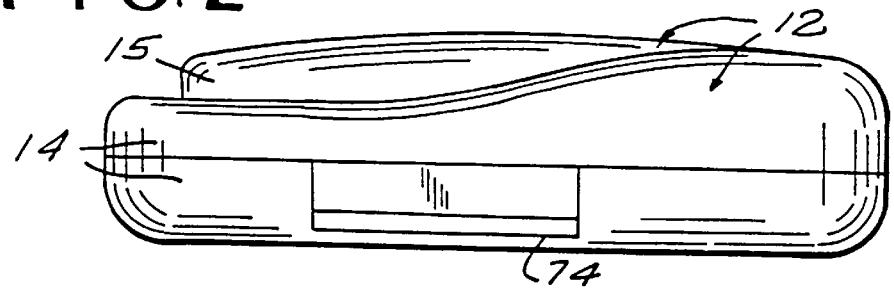
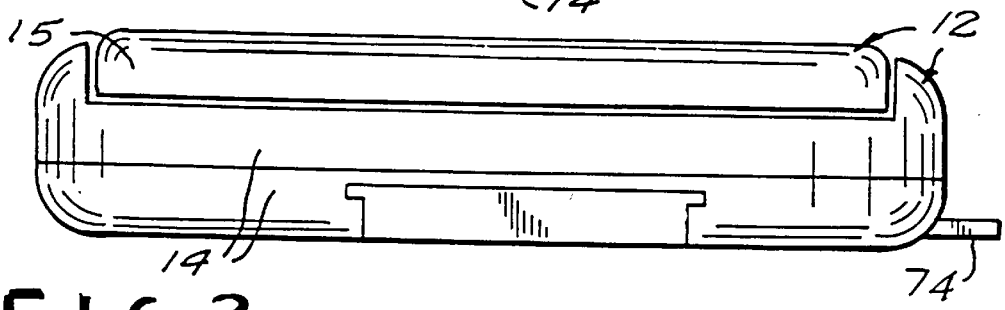
FIG. 3

SIMULATED COMPUTER

BACKGROUND OF THE INVENTION

The present invention relates to a simulated computer, and more particularly to a simulated talking laptop computer having user-operable selecting means.

In a conventional computer, the user has the option of selecting an activity or topic (for example, stock market reports, weather forecasts, and the like) and obtaining, via the computer, a response which is specific to the selected activity or topic. A simulated computer should offer the same option.

In addition, while a simulated computer cannot offer the entire sequence of events which may occur during use of a conventional computer, it should be able to provide a sequence of simulated computer play including a plurality of sequential events. Even a child-user will quickly realize that the computer is only a simulation if the sequence of simulated computer play always includes the exact same plurality of sequential events, regardless of the input provided by the user. A simulated computer should, at the very least, perform a sequence of simulated computer play which commences at an event responsive to some user input.

Accordingly, it is an object of the present invention to provide a simulated computer, especially a simulated talking laptop computer, including user-operable selection means.

Another object is to provide such a simulated computer including means for performing a sequence of simulated computer play including a plurality of sequential events, with the sequence of play commencing at an event responsive to the user-operable selection means.

SUMMARY OF THE INVENTION

It has now been found that the above and related objects of the present invention are obtained in a simulated computer comprising a plurality of images, including at least one character image and a plurality of activity images, user-operable means for selecting one of the plurality of images, and means for illuminating a selected one of the plurality of activity images to indicate a selected activity. Means are provided for simulating talk by a character represented by the character image and for illuminating the character image during simulated talk by the character. User-operable means are provided for selecting a simulated computer function such as On/Off, Dial, Select, Send/Receive, Character. Processing means performs a sequence of simulated computer play including a plurality of sequential events, the sequence of play commencing at an event responsive to the selected simulated computer function selection means.

Preferably, the simulated computer includes a laptop housing with a base and a screen for viewing the images, the screen being pivotable relative to the base.

In a preferred embodiment, the image selecting means selects an image by default in the absence of user input to the image selecting means. The function selection means includes at least one of an on key, a dial key, an image selection key, a send/receive key and a character key, and preferably at least one of each.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 1 is a top plan view of a simulated talking laptop computer according to the present invention, with the housing in the closed orientation;

FIG. 2 is a side elevational view thereof;

FIG. 3 is a back elevational view thereof;

DETAILED DESCRIPTION OF THE PREFERRED EMBODIMENTS

Figure 4:
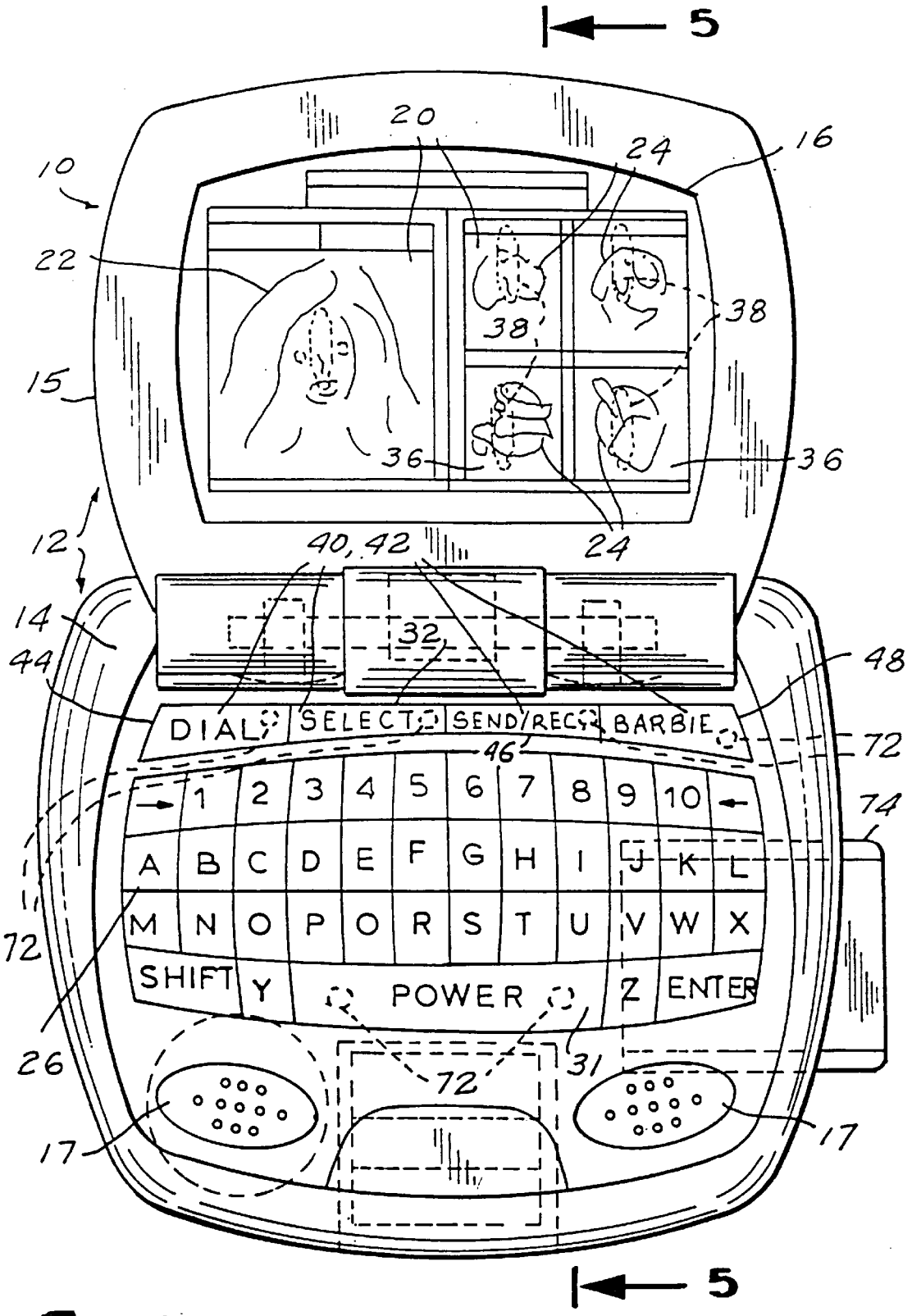
FIG. 4 is a front elevational view thereof, with the housing in the open orientation.

Referring now to the drawing, and in particular to FIGS. 1–3 thereof, therein illustrated is a simulated computer according to the present invention, generally designated by the reference numeral 10. As illustrated, the computer is a laptop computer having a housing 12 including a base 14 and a top 15 for viewing at least one of a variety of images. The top 15 is pivotable relative to the base 14, as in an actual laptop computer. The top 15 and base 14 are pivotally secured together by a conventional hinge mechanism. The base 14 additionally includes at least one speaker 17 through which sound can be emitted when produced by a sound chip (not shown) powered by batteries 18.

Figure 5:
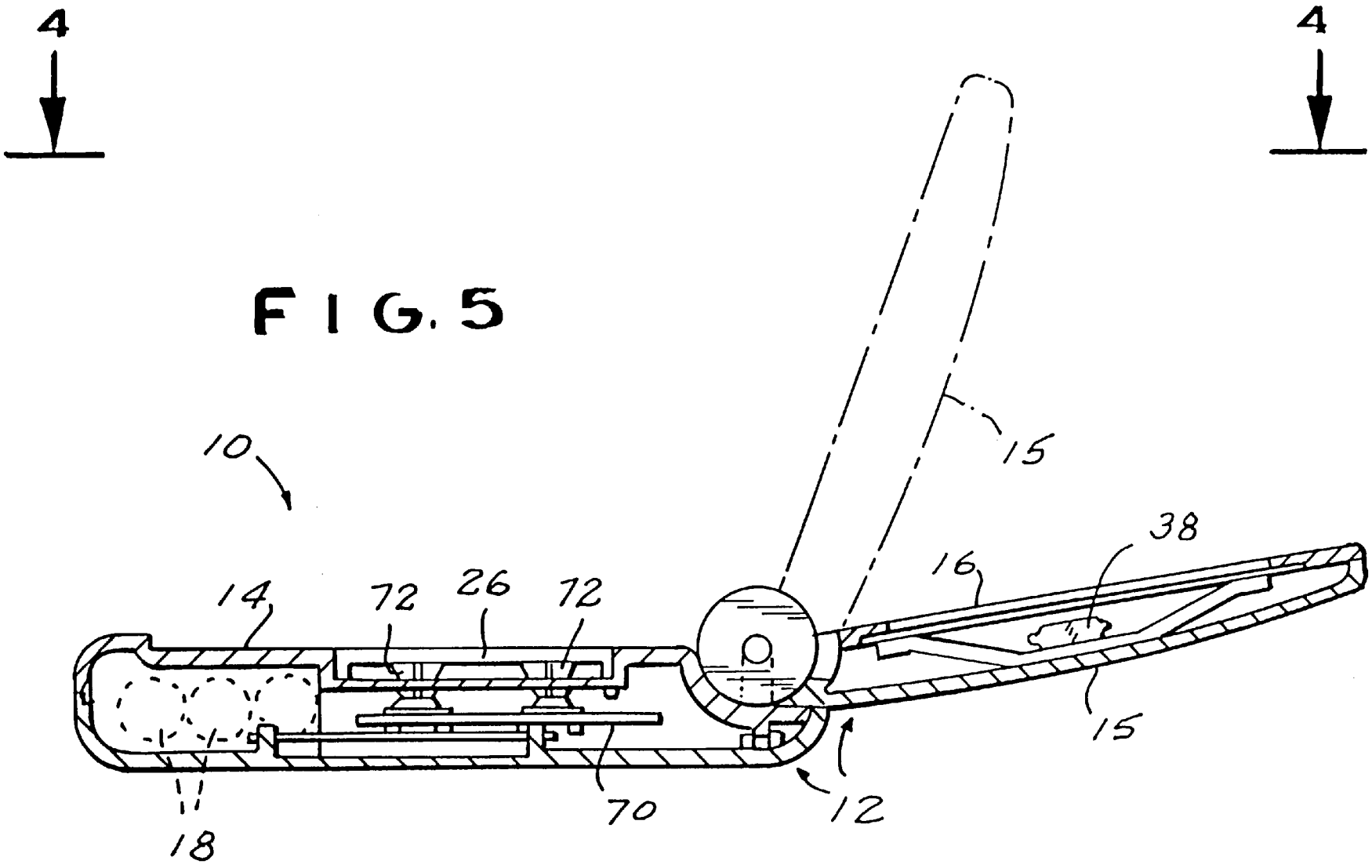
FIG. 5 is a sectional view taken along the line 5—5 of FIG. 4, with the top of the housing being illustrated in alternative orientations in solid line and in dashed line.

Referring now to FIGS. 4 and 5 as well, the screen 16 on the undersurface of top 15 has a plurality of images 20 thereon including at least one character image 22 and a plurality of activity images 24. The character image 22 is typically greater in size then the activity images and, as illustrated, occupies about 50% of the screen 16. The character represented by the character image 22 may be real or imaginary, human or otherwise, but it is preferably associated with the ability to speak (such as a human being). As illustrated, there is only one character image 22, and that is the character image of BARBIE® of the famous BARBIE® Doll.

The activity images 24 may represent any pre-selected activities, for example, vacation, party, shopping, pen-pal, wedding, latest trends, or the like. As illustrated, there are four activity images, and each occupies an eighth of the screen 16 (in total about half of the screen). A greater or lesser number of activity images 24 may be present.

The base 14 appears to present a conventional alphanumeric keyboard 26 including the alphabet letters, the numeric digits and such other conventional keys as may be desired (for example, a shift key, an enter key, a backspace key, and the like). While the keys may be movable and may even respond to selection by the user in some manner (for example, by briefly becoming illuminated), essentially the alphanumeric keys are totally non-functional and have existence only as pictorial representations on the upper surface of the base 14.

One user-operable key, such as the space or power bar 31, may serve the function of a user-operable on/off key provided to turn the simulated computer on and off. However, this on/off function may alternatively be performed simply by the acts of pivoting the top 15 away from the base 14 (to turn the simulated computer on) as in FIGS. 4–5 or pivoting the top 15 until it seats on the base (to turn the simulated computer off) as in FIGS. 1–3.

The 14 base additionally defines a plurality of user-operable means 40 for selecting a simulated computer function, for example, a plurality of function selection keys generally designated 42. Typically, the simulated computer function selection means includes at least one of an On/off key (here, the space or power bar 31), a Dial key 44, an activity image Select key 32, a Send/receive key 46, and a Character key 48 (here, BARBIE®), and optimally as illustrated in FIG. 4 each of such keys. It will be appreciated that these are only representative simulated computer function keys 42 and that a variety of additional simulated computer function keys, such as a DOWNLOAD key or a REVIEW key, may be used in addition to, or instead of, one of the aforementioned function keys 42. Simulated computer function keys 42 may activate sound effects such as a simulation of dialing sounds (for a Dial key 44), a transmitting or receiving sound (for a Send/Receive key 46 and talk by the character (for a Character key 48. While four simulated computer function keys 42 and the on/off bar 31 are illustrated, a lesser or greater number of such keys may be present. Selecting one of the user-operable means for selecting a simulated computer function (e.g., keys 32, 44, 46, 48 preferably results in a temporary illumination of the selected key. Sensors are disposed to detect actuation of each of the function keys 42 (including the space or power bar 31 and report selection to a processing means. In FIG. 5, the sensing means 72 are illustrated under the simulated computer function keys 42 and the power bar 31.

Preferably one of the user-operable means 40 is operable to select one of the plurality of images 20 (including both the character image 22 and the activity images 24, or optimally only one of the plurality of activity images 24. The user-operable means for selecting one of the plurality of activity images 24 may be a "Select" key 32. Preferably, the image selecting means will eventually select an image 20 by default in the absence of any user input thereto for a predetermined period of time (e.g., seven seconds). In the absence of user input, typically a preselected or randomly chosen image 20 will initially be selected, with the user having the option of successively changing the selection from the initially selected image 20 through each of the remaining images 20 by repeated depression of the Select key 32. Thus, one of the plurality of images 20 is tentatively selected by the device, with the user having the option to modify the tentative selection through operation of the Select key 32. Indeed, a plurality of the activity images 24 may be selectable simultaneously (by the user or by default) in particular embodiments.

Typically, the images 20 are disposed on a transparent or translucent surface 36 having a lamp or other illuminating means 38 disposed therebehind, and the tentative and final selections of a given image 20 are each evidenced by illumination of the lamp 38 behind that particular image 20. In the absence of user input over a given period of time, preferably the various images 20 will be briefly illuminated in turn (e.g., in a clockwise succession) while the computer "makes up its mind." The sequence of flashing lights, whether or not accompanied by sound effects, is very appealing to a child.

Referring now to Table 1, therein illustrated is a sequential flowchart showing the simulated computer play sequence. Table 2 illustrates, by way of example only, the lists of phrases which may be spoken at various times—i.e., speech lists A–J.

The computer play pattern of Table 1 is divided into a plurality of sequential events initiated by user actuation of an On/off key (or opening of the housing 12 by pivoting of the top 15 relative to the base 14 in order to produce start-up sound effects (SFX), light the character image 22, have the character image 22 say a Welcome Phrase selected from speech list A (e.g., "Welcome") and then turn the character image light off—that is, events a and b.

Upon user selection of the simulated computer function Dial key 44, the device produces modem dial-up sound effects and server connection sound effects (such as those accompanying connection with a typical server) with the character image lamp then being turned on, the character image 22 saying a Mail Phrase selected from speech list B (e.g., "You got mail"), and the character image light being turned off—that is, event c.

Upon user selection of the image Select key 32, the lamps behind each of the activity images 24 (and optionally the character image 22 are briefly turned on and off in sequence to produce a rotating illumination. Preferably, a song or music is played while the illuminations are rotating. In the absence of user input to the image Select key 32, one activity is eventually selected at random. The lamps are turned on and off in sequence during the selection process, but eventually only one remains on to indicate the activity selected by default. At this point, the character image lamp is turned on, and the character image 22 says a Default Selection Phrases selected from speech list D followed by an Instruction Phrase from speech list E. The Default Selection Phrase and Instruction Phrase are related to the activity image selected by default. Thereafter, the character image lamp is turned off. This is event d.

It will be appreciated that the Default Selection Phrases in speech list D and the Instruction Phrases in speech list E are preferably related to the specific activity images 24 present on the computer screen 16—e.g., party planning (party), vacation planning (vacation), shopping on-line (shopping) and pen-pals (pen-pal). The various planning activities may be designated "on-line". The Default Selection Phrases of speech list D indirectly inform the user of the default activity image selection by using the activity in a sentence which compliments the user. The Instruction Phrase of speech list E is also preferably related to the activity of the selected activity image. The Instruction Phrase of speech list E typically tells the user to do something—for example, to go to a particular site or on-line for a particular activity, to surf the web or net, to send e-mail or ideas to the character represented by the character image, or the like.

Upon user selection of the Send/receive key 46, the character image lamp is turned on, the character image 22 says a Send File Phrase from speech list F and the character image light turns off—that is, event e. The Send File Phrase of speech list F is typically "Sending file" or "Sending e-mail" to give the impression that the child is communicating with other computers by sending them the user's file or e-mail and then receiving the recipient's file or e-mail. A song, preferably different from the song played during activity image selection, may be played, and preferably the lamp associated with the selected activity image is blinked for a period of time (perhaps about seven seconds) to give the impression of transmissions being sent and another being received. Thereafter, the character image lamp is turned on, the character image 22 says an E-mail Received Phrase from speech list G and the character image lamp is then turned off—this is also part of event e. The E-mail Received Phrase of speech list G is preferably related to the Instruction Phrase of speech list E in the sense that it acknowledges receipt of a file, plan, ideas, e-mail or the like as mentioned in the Instruction Phrase.

Upon user selection of the Character key 48, the character image lamp is turned on, the character image 22 says a Compliment Phrase from speech list H (event f), a Play Again Phrase from speech list I (also event f), and a Good-bye Phrase from speech list J (event g), and then the character image lamp is turned off (event h) and eventually the remainder of the device is turned off (event i)—that is, events f–i. The Compliment Phrase of speech list H is selected to be related to the Instruction Phrase used from speech list E, the Send File Phrase used from speech list F, and the E-mail Received Phrase used from speech list G. Typically, the Compliment Phrase compliments the user for some activity or for his e-mail or file. The Play Again Phrase of speech list I suggests a repeat of the activity already performed in relatively generic terms of "Let's go on-line again" (or "on the net" or "on the web") or "Let's surf the line again (or "net" or "web"). The Good-bye Phrase of speech list J is simply "Bye, bye." The computer is automatically turned down a brief period of time after the Good-bye Phrase is spoken (event g), or even earlier if the power On/off key (here, the space or power bar 31 is again actuated by the user. The off key function is typically initiated simply by a second actuation of the On/off key.

In a variant of this play pattern particularly suitable when the user knows which image 20 he desires to select, after the On/off key 31 has been actuated (for example, by opening the device housing), the power is turned on and the start-up sound effects begin. At this point, the user may actuate the user-operable image Select key 32, preferably before the activity images 24 are illuminated in rotation. The user's actuation of the activity image Select key 32 causes the character image lamp to be turned on, the character image 22 to say a Child Select Phrase from speech list C, and the character image light then turned off—that is, alternative event aa. The Child Select Phrases of speech list C congratulate the user on the particular selected activity (represented by the selected activity image). After alternative event aa, the play pattern continues with event d. Thus, the activity images are next illuminated in turn, a song is played, and then the rotation of illumination ceases with the one selected activity image remaining illuminated.

Actuation of a simulated computer function key 42 interrupts any ongoing play pattern and causes the play pattern to begin at a particular point in the sequence of events. Thus, actuation of the On/off key 31 causes the play pattern to proceed from event a to event i. Actuation of the Dial key 44 causes the play pattern to proceed from event c to event i. Actuation of the activity image Select key 32 causes the play pattern to begin with event aa and then proceed from event d to event i. Actuation of the Send/receive key 46 causes the play pattern to proceed from event e through event i. Actuation of the Character key 48 (here, the BARBIE® key) causes the play pattern to proceed from event f through event i. Thus, the sequence of play remains unchanged, with only the starting point changing in reference to actuation of a simulated computer function key.

However user operation of the activity image Select key 48, immediately after turn on of the device or at any time during the play pattern, may be thought of as causing the selection of an alternative entry point into the sequence of events—namely, an alternative entry aa which bypasses and replaces events a, and c so that the user can proceed immediately to event d. Thus, the experienced user can skip the Welcome Phrase from speech list A and the Mail Phrase from speech list B.

The play pattern indicated in Table 1 is implemented by processing means (such as a microprocessing chip 70 for performing a sequence of simulated computer play including a plurality of sequential events. The sequence of play commences at an event responsive to the selected computer function (selected by one of the computer function keys 42 and continues to the final event i without further user input, unless interrupted (by user selection of a computer function key 42).

In the preferred embodiment illustrated in Table 1, the user-operable means for selecting a simulated computer function are the On/off key or spacer bar 31 (which initiates events a and b) the Dial key 44 (which initiates event c), the Send/receive key 46 (which initiates event e) and the Character key 48 (which initiates events f through i). The image activity Select key initiates event aa followed by entry into event d (which otherwise occurs only immediately after event c).

It will be appreciated that immediately before the character image 22 speaks the character image light is turned on, and immediately after it speaks the character image light is turned off.

The base 14 may be provided with a slot adapted to receive a removable simulated data storage mechanism, such as a compact disk 74, to improve the simulation of an actual laptop computer. Clearly various other features commonly associated with a laptop computer may be added to the device 10 according to the present invention in order to enhance the similitude thereof to a real computer. For example, a latching mechanism may be provided to maintain the housing 12 in a closed orientation.

To summarize, the present invention provides a simulated computer, especially a simulated talking laptop computer, including user-operable selection means and means for performing a sequence of simulated computer play including a plurality of sequential events, with the sequence of play commencing at an event responsive to the user-operable selection means.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

TABLE 1

PROPOSED PLAY PATTERN

| | event | |
|---|---|---|
| on/off key | a | press power on/off button |
| | a | start up sfx A |
| | b | barbie lamp on |
| | b | Barbie says WELCOME PHRASE (speech list A) |
| | b | Barbie lights off |
| dial key | c | sfx B modem dial up sfx |
| | c | sfx C aol connection sfx |
| | c | Barbie lamp on |
| | c | Barbie says MAIL PHRASE (speech list B) |
| | c | Barbie lights off GO TO d |
| select key | aa | press select key |
| | aa | barbie lamp on |
| | aa | Barbie says CHILD SELECT PHRASE (speech list C) |
| | aa | Barbie lights off GO TO d |
| | d | 4 icons rotate |
| | d | song A plays |
| | d | programmed random selection |
| | d | icons stop rotating and 1 stays on |
| | d | Barbie lamp on |
| | d | Barbie says DEFAULT SELECTION PHRASE (speech list D) |
| | d | Barbie says INSTRUCTION PHRASE (speech list E) |
| | d | Barbie lamp off |

TABLE 1-continued

| PROPOSED PLAY PATTERN | | |
|---|---|---|
| snd/rec key | e | Barbie lamp on |
| | e | Barbie says SEND FILE PHRASE (speech list F) |
| | e | Barbie lamp off |
| | e | song B plays and selected icon light blinks |
| | e | Barbie lamp on |
| | e | Barbie says EMAIL RECEIVED (speech list G) |
| | e | Barbie lamp off |
| Barbie key | f | Barbie lamp on |
| | f | Barbie says COMPLIMENT PHRASE (speech list H) |
| | f | Barbie says PLAY AGAIN PHRASE (speech list I) |
| | g | Barbie says GOOD BYE PHRASE (speech list J) |
| | h | Barbie lamp off |

TABLE 1-continued

| PROPOSED PLAY PATTERN | | |
|---|---|---|
| off key | 1 | power down after idle for 3 sec |

NOTES 1 on button is power on/off with speech list I 2 each KEY powers up from its specific location in the script and runs thru power down

| key | goes from | thru |
|---|---|---|
| on/off | a | i |
| dial | c | i |
| select | aa | i |
| send/rec | e | i |
| Barbie | f | i |
| on/off 2ndpress | anywhere | i |

3 auto power down after 5 sec with bye bye

TABLE II

| | | | | | | | |
|---|---|---|---|---|---|---|---|
| | speech list A | WELCOME | | | | | |
| | 1 Hi | its | Barbie | dot | com | | |
| | 2 its | Barbie | dot | com | | | |
| | 3 Hi | its | Barbie | | | | |
| | 4 its | Barbie | | | | | |
| | speech list B | MAIL | | | | | |
| | 1 you | got | mail | | | | |
| | speech list C | CHILD SELECT | | | | | |
| p | 1 awesome | you | chose | on | line | party | planning |
| v | 2 awesome | you | chose | on | line | vacation | planning |
| pp | 3 awesome | you | chose | pen | pals | | |
| s | 4 awesome | you | chose | shopping | on | line | |
| p | 5 cool | you | chose | on | line | party | planning |
| v | 6 cool | you | chose | on | line | vacation | planning |
| p | 7 cool | you | chose | party | planning | on | line |
| p | 8 cool | you | chose | party | planning | | |
| pp | 9 cool | you | chose | pen | pals | | |
| s | 10 cool | you | chose | shopping | on | line | |
| v | 11 cool | you | chose | vacation | travel | on | line |
| v | 12 cool | you | chose | vacation | travel | | |
| v | 13 neat | you | chose | on | line | vacation | travel |
| v | 14 neat | you | chose | on | line | vacation | planning |
| pp | 15 neat | you | chose | pen | pals | | |
| s | 16 neat | you | chose | shopping | on | line | |
| p | 17 you | chose | on | line | party | planning | |
| v | 18 you | chose | on | line | vacation | planning | |
| pp | 19 you | chose | pen | pals | | | |
| s | 20 you | chose | shopping | on | line | | |
| | speech list D | DEFAULT SELECT | | | | | |
| p | 1 on | line | party | planning | is | cool | |
| p | 2 on | line | party | planning | is | awesome | |
| p | 3 on | line | party | planning | is | neat | |
| s | 4 on | line | shopping | is | cool | | |
| s | 5 on | line | shopping | is | awesome | | |
| s | 6 on | line | shopping | is | neat | | |
| v | 7 on | line | vacation | travel | is | cool | |
| v | 8 on | line | vacation | travel | is | awesome | |
| v | 9 on | line | vacation | travel | is | neat | |
| p | 10 party | planning | on | line | is | cool | |
| p | 11 party | planning | on | line | is | awesome | |
| p | 12 party | planning | on | line | is | neat | |
| pp | 13 pen | pals | are | neat | | | |
| pp | 14 pen | pals | are | cool | | | |
| pp | 15 pen | pals | are | awesome | | | |
| pp | 16 pen | pals | on | line | are | neat | |
| pp | 17 pen | pals | on | line | are | cool | |
| pp | 18 pen | pals | on | line | are | awesome | |
| s | 19 shopping | on | line | is | cool | | |
| s | 20 shopping | on | line | is | awesome | | |
| s | 21 shopping | on | line | is | neat | | |

TABLE II-continued

| | | | | | | | | | | | |
|---|---|---|---|---|---|---|---|---|---|---|---|
| v | 22 | vacation | travel | on | line | is | cool | | | | |
| v | 23 | vacation | travel | on | line | is | awesome | | | | |
| v | 24 | vacation | travel | on | line | is | neat | | | | |
| | speech list E | | INSTRUCTION | | | | | | | | |
| p | 1 | go | on | line | to | party | planning | | | | |
| p | 2 | go | on | line | to | Barbie | dot | com | | | |
| pp | 3 | go | on | line | to | pen | pals | | | | |
| s | 4 | go | on | line | to | shopping | | | | | |
| s | 5 | go | on | line | for | shopping | ideas | | | | |
| v | 6 | go | on | line | to | vacation | planning | | | | |
| v | 7 | go | on | line | for | vacation | ideas | | | | |
| p | 8 | go | to | on | line | party | planning | | | | |
| p | 9 | surf | the | web | to | Barbie | dot | com | | | |
| s | 10 | go | to | on | line | shopping | | | | | |
| v | 11 | go | on | line | for | vacation | planning | | | | |
| p | 12 | lets | send | party | ideas | to | Barbie | dot | com | | |
| p | 13 | go | to | party | planning | | | | | | |
| s | 14 | send | your | shopping | ideas | to | Barbie | dot | com | | |
| s | 15 | go | to | shopping | | | | | | | |
| v | 16 | send | your | vacation | ideas | to | Barbie | dot | com | | |
| v | 17 | go | to | vacation | | | | | | | |
| pp | 18 | lets | send | an | awesome | email | to | Barbie | | | |
| pp | 19 | lets | send | an | awesome | email | to | cool | pen | pals | |
| pp | 20 | lets | send | an | email | to | pen | pals | | | |
| pp | 21 | lets | send | an | email | to | Barbie | | | | |
| pp | 22 | lets | send | cool | email | to | awesome | pen | pals | | |
| pp | 23 | lets | send | cool | email | to | Barbie | | | | |
| pp | 24 | lets | send | neat | email | to | cool | pen | pals | | |
| p | 25 | lets | surf | the | net | for | party | ideas | | | |
| v | 26 | lets | surf | the | net | for | vacation | ideas | | | |
| s | 27 | lets | surf | the | net | for | on | line | shopping | | |
| p | 28 | lets | surf | the | web | for | party | ideas | | | |
| v | 29 | lets | surf | the | web | for | vacation | ideas | | | |
| g | 30 | lets | surf | the | web | for | great | ideas | | | |
| g | 31 | lets | surf | the | web | for | cool | ideas | | | |
| s | 32 | lets | send | your | awesome | shopping | ideas | to | Barbie | | |
| s | 33 | lets | send | your | cool | shopping | ideas | to | Barbie | | |
| s | 34 | lets | send | your | neat | shopping | ideas | to | Barbie | | |
| v | 35 | lets | send | your | awesome | vacation | ideas | to | Barbie | | |
| v | 36 | lets | send | your | neat | vacation | ideas | to | Barbie | | |
| v | 37 | lets | send | your | cool | vacation | ideas | to | Barbie | | |
| s | 38 | lets | send | your | awesome | shopping | ideas | to | Barbie | dot | com |
| s | 39 | lets | send | your | cool | shopping | ideas | to | Barbie | dot | com |
| s | 40 | lets | send | your | neat | shopping | ideas | to | Barbie | dot | com |
| v | 41 | lets | send | your | awesome | vacation | ideas | to | Barbie | dot | com |
| v | 42 | lets | send | your | neat | vacation | ideas | to | Barbie | dot | com |
| v | 43 | lets | send | your | cool | vacation | ideas | to | Barbie | | |
| p | 44 | lets | send | your | party | ideas | to | Barbie | | | |
| p | 45 | lets | send | your | party | ideas | to | Barbie | dot | com | |
| s | 46 | lets | send | your | shopping | ideas | to | Barbie | | | |
| s | 47 | lets | send | your | shopping | ideas | to | Barbie | dot | com | |
| v | 48 | lets | send | your | vacation | ideas | to | Barbie | | | |
| v | 49 | lets | send | your | vacation | ideas | to | Barbie | dot | com | |
| pp | 50 | send | an | awesome | email | to | Barbie | | | | |
| pp | 51 | send | an | awesome | email | to | cool | pen | pals | | |
| s | 52 | send | your | awesome | shopping | ideas | to | Barbie | | | |
| v | 53 | send | your | cool | vacation | ideas | to | Barbie | | | |
| pp | 54 | send | cool | email | to | awesome | pen | pals | | | |
| pp | 55 | send | cool | email | to | Barbie | | | | | |
| pp | 56 | send | an | email | to | pen | pals | | | | |
| pp | 57 | send | an | email | to | Barbie | | | | | |
| pp | 58 | send | neat | email | to | cool | pen | pals | | | |
| p | 59 | send | your | party | ideas | to | Barbie | | | | |
| p | 60 | send | your | party | ideas | to | Barbie | dot | com | | |
| s | 61 | send | your | shopping | ideas | to | Barbie | | | | |
| s | 62 | send | your | shopping | ideas | to | Barbie | dot | com | | |
| v | 63 | send | your | vacation | ideas | to | Barbie | | | | |
| v | 64 | send | your | vacation | ideas | to | Barbie | dot | com | | |
| p | 65 | surf | the | net | for | party | ideas | | | | |
| p | 66 | surf | the | net | for | awesome | party | ideas | | | |
| p | 67 | surf | the | net | for | cool | party | ideas | | | |
| p | 68 | surf | the | net | for | neat | party | ideas | | | |
| v | 69 | surf | the | net | for | vacation | ideas | | | | |
| s | 70 | surf | the | net | for | on | line | shopping | | | |
| p | 71 | surf | the | web | for | party | ideas | | | | |
| p | 72 | surf | the | web | for | party | ideas | | | | |
| p | 73 | surf | the | web | for | awesome | party | ideas | | | |
| p | 74 | surf | the | web | for | cool | party | ideas | | | |
| p | 75 | surf | the | web | for | neat | party | ideas | | | |

TABLE II-continued

| | | | | | | | | | | | |
|---|---|---|---|---|---|---|---|---|---|---|---|
| v | 76 | surf | the | web | for | neat | party | ideas | | | |
| s | 77 | surf | the | web | for | on | line | shopping | | | |
| v | 78 | go | on | line | for | vacation | ideas | to | Barbie | dot | com |
| g | 79 | surf | the | web | for | great | ideas | | | | |
| g | 80 | surf | the | web | for | cool | ideas | | | | |
| | speech list F | | SEND FILE | | | | | | | | |
| | 1 | sending | file | | | | | | | | |
| | 2 | sending | email | | | | | | | | |
| | speech list G | | EMAIL RECEIVED | | | | | | | | |
| | 1 | awesome | \| | got | the | file | | | | | |
| | 2 | awesome | \| | got | the | plan | | | | | |
| | 3 | awesome | \| | got | the | email | | | | | |
| | 4 | cool | \| | got | the | file | | | | | |
| | 5 | cool | \| | got | the | plan | | | | | |
| | 6 | | | | | | | | | | |
| | 7 | cool | \| | got | the | email | | | | | |
| | 8 | cool | \| | got | the | email | | | | | |
| | 9 | \| | got | the | file | | | | | | |
| | 10 | \| | got | the | plan | | | | | | |
| | 11 | | | | | | | | | | |
| | 12 | \| | got | the | file | its | awesome | | | | |
| | 13 | \| | got | the | plan | cool | | | | | |
| | 14 | \| | got | the | email | cool | | | | | |
| | 15 | neat | \| | got | the | file | | | | | |
| | 16 | neat | \| | got | the | plan | | | | | |
| | 17 | neat | \| | got | the | email | | | | | |
| | speech list H | | COMPLIMENT | | | | | | | | |
| | 1 | awesome | email | | | | | | | | |
| | 2 | awesome | file | | | | | | | | |
| | 3 | cool | email | | | | | | | | |
| | 4 | cool | file | | | | | | | | |
| | 5 | neat | email | | | | | | | | |
| | 6 | neat | file | | | | | | | | |
| | 7 | you | do | awesome | planning | | | | | | |
| | 8 | you | do | cool | planning | | | | | | |
| | 9 | you | do | neat | planning | | | | | | |
| | 10 | you | got | awesome | ideas | | | | | | |
| | 11 | you | got | cool | ideas | | | | | | |
| | 12 | you | got | neat | ideas | | | | | | |
| | 13 | you | plan | awesome | ideas | | | | | | |
| | 14 | you | plan | cool | ideas | | | | | | |
| | 15 | you | plan | neat | ideas | | | | | | |
| | 16 | you | send | awesome | email | | | | | | |
| | 17 | you | send | cool | email | | | | | | |
| | 18 | you | send | neat | email | | | | | | |
| | 19 | your | email | is | cool | | | | | | |
| | 20 | your | email | is | awesome | | | | | | |
| | 21 | your | email | is | neat | | | | | | |
| | 22 | your | file | is | cool | | | | | | |
| | 23 | your | file | is | awesome | | | | | | |
| | 24 | your | file | is | neat | | | | | | |
| | 25 | your | plan | is | cool | | | | | | |
| | 26 | your | plan | is | awesome | | | | | | |
| | 27 | your | plan | is | neat | | | | | | |
| | speech list I | | PLAY AGAIN | | | | | | | | |
| | 1 | lets | go | on | line | again | | | | | |
| | 2 | lets | go | on | the | net | again | | | | |
| | 3 | lets | go | on | the | web | again | | | | |
| | 4 | lets | surf | the | net | again | | | | | |
| | 5 | lets | surf | the | web | again | | | | | |
| | 6 | lets | go | again | and | surf | the | web | | | |
| | speech list J | | GOOD BYE | | | | | | | | |
| | 1 | bye | bye | | | | | | | | |

We claim:

1. A simulated computer comprising:

(A) a plurality of images including at least one character image and a plurality of activity images;

(B) user-operable means for selecting one of said plurality of activity images;

(C) means for illuminating a selected one of said plurality of activity images to indicate a selected activity;

(D) means for simulating talk by a character represented by said character image;

(E) means for illuminating said character image during simulated talk by the character;

(F) user-operable means for selecting a simulated computer function; and (G) processing means for performing a sequence of simulated computer play including a plurality of sequential events, said sequence of play commencing at an event responsive to the selected computer function.

2. The simulated computer of claim 1 including a laptop housing with a base and a screen for viewing said images, said screen being pivotable relative to said base.

3. The simulated computer of claim 1 wherein said image selecting means selects an image by default in the absence of user input to said image selecting means.

4. The simulated computer of claim 1 wherein said function selection means includes at least one of an on key, a dial key, an image selection key, a send/receive key, and a character key.

5. The simulated computer of claim 1 wherein said function section means includes an on key, a dial key, an image selection key, a send/receive key, and a character key.

6. A simulated talking laptop computer comprising:

(A) a plurality of images including at least one character image and a plurality of activity images;

(B) user-operable means for selecting one of said plyurality of activity images, said image selecting means selecting an image by default in the absence of user input to said image selecting means;

(C) means for illuminating a selected one of said plurality of activity images to indicate a selected activity;

(D) means for simulating talk by a character represented by said character image;

(E) means for illuminating said one character image during simulated talk by the character;

(F) user-operable means for selecting a simulated computer function, said function selection means including an on key, a dial key, an image selection key, a send/receive key, and a character key;

(G) means for performing a sequence of simulated computer play including a plurality of sequential events, said sequence of play commencing at an event responsive to said function selection means; and (H) a laptop housing with a base and a screen for viewing said images, said screen being pivotable relative to said base.

* * * * *